US009984809B2

(12) United States Patent
Wakamori et al.

(10) Patent No.: US 9,984,809 B2
(45) Date of Patent: May 29, 2018

(54) COIL COMPONENT AND METHOD FOR PRODUCING SAME

(71) Applicant: PANASONIC INTELLECTUAL PROPERTY MANAGEMENT CO., LTD., Osaka (JP)

(72) Inventors: Ikuya Wakamori, Hyogo (JP); Mutsuyasu Ohtsubo, Hyogo (JP); Manabu Satou, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days. days.

(21) Appl. No.: 15/117,081

(22) PCT Filed: Mar. 9, 2015

(86) PCT No.: PCT/JP2015/001269
§ 371 (c)(1),
(2) Date: Aug. 5, 2016

(87) PCT Pub. No.: WO2015/136909
PCT Pub. Date: Sep. 17, 2015

(65) Prior Publication Data

US 2016/0351323 A1 Dec. 1, 2016

(30) Foreign Application Priority Data

Mar. 14, 2014 (JP) ..... 2014-051519
Jan. 6, 2015 (JP) ..... 2015-001166

(51) Int. Cl.
*H01F 27/29* (2006.01)
*H01F 27/02* (2006.01)
(Continued)

(52) U.S. Cl.
CPC ..... *H01F 27/2823* (2013.01); *H01F 17/04* (2013.01); *H01F 17/041* (2013.01);
(Continued)

(58) Field of Classification Search
CPC ..... H01F 27/292; H01F 27/02; H01F 27/29; H01F 27/306; H01F 41/10; H01F 27/24
(Continued)

(56) References Cited

U.S. PATENT DOCUMENTS 4,498,067 A * 2/1985 Kumokawa ..... H01F 5/00 336/192
4,623,865 A * 11/1986 Kiesel ..... H01F 27/027 336/174
(Continued)

FOREIGN PATENT DOCUMENTS

CN 101345121 A 1/2009
CN 102290194 A 12/2011
(Continued)

OTHER PUBLICATIONS

International Search Report and Written Opinion issued in International Patent Application No. PCT/JP2015/001269, dated May 19, 2015; with partial English translation.
(Continued)

*Primary Examiner* — Alexander Talpalatski
*Assistant Examiner* — Joselito Baisa
(74) *Attorney, Agent, or Firm* — McDermott Will & Emery LLP

(57) ABSTRACT

A coil component according to the present invention includes: a magnetic core made of a mixture of a powdery magnetic material and a binding agent and obtained by press forming the mixture; a coil element embedded in the magnetic core and having an end portion protruding from the magnetic core; and a holding member configured to hold the
(Continued)

end portion of the coil element. The holding member has a first slit and a second slit which faces the first slit. The end portion of the coil element and the holding member are welded together in an area between the first slit and the second slit.

8 Claims, 8 Drawing Sheets

(51) Int. Cl.

| | |
|---|---|
| ***H01F 7/06*** | (2006.01) |
| ***H01F 27/28*** | (2006.01) |
| ***H01F 17/04*** | (2006.01) |
| ***H01F 41/10*** | (2006.01) |
| ***H01F 41/064*** | (2016.01) |
| ***H01F 27/255*** | (2006.01) |
| ***H01F 41/02*** | (2006.01) |

(52) U.S. Cl.
CPC ..... *H01F 27/255* (2013.01); *H01F 27/29* (2013.01); *H01F 41/0246* (2013.01); *H01F 41/064* (2016.01); *H01F 41/10* (2013.01); *H01F 2017/048* (2013.01)

(58) Field of Classification Search
USPC ..... 336/192, 82, 83; 29/602.1
See application file for complete search history.

(56) References Cited

U.S. PATENT DOCUMENTS 4,754,250 A * 6/1988 Duin ..... H01F 27/027 336/205
5,675,121 A * 10/1997 Machado ..... H01F 27/292 174/138 R
8,156,634 B2 * 4/2012 Gallup ..... H01F 17/043 29/605
8,217,745 B2 * 7/2012 Tien ..... H01F 17/062 336/196
8,471,665 B2 * 6/2013 Urano ..... H01F 27/292 336/192
8,922,317 B2 * 12/2014 Yamada ..... H01F 17/043 336/192
2006/0284716 A1 * 12/2006 Yamaguchi ..... H01F 3/14 336/199
2007/0018770 A1 * 1/2007 Kamio ..... H01F 3/14 336/221
2007/0057758 A1 * 3/2007 Sano ..... H01F 17/045 336/212
2007/0241850 A1 * 10/2007 Watanabe ..... H01F 27/027 336/73
2008/0290975 A1 * 11/2008 Watanabe ..... H01F 17/045 336/90
2011/0260821 A1 10/2011 Yamada et al.
2012/0188045 A1 7/2012 Yamada et al.
2013/0154780 A1 6/2013 Yamada et al.
2014/0090235 A1 4/2014 Yamada et al.

FOREIGN PATENT DOCUMENTS

JP S62-213212 A 9/1987
JP 2005-310812 A 11/2005
JP 2009-010345 A 1/2009
JP 2011-249770 A 12/2011
JP 2013-045871 A 3/2013
JP 2013-125896 A 6/2013
JP 2013-191726 A 9/2013

OTHER PUBLICATIONS

English Translation of Chinese Search Report dated Aug. 18, 2017 for the related Chinese Patent Application No. 201580012271.1.

* cited by examiner

COIL COMPONENT AND METHOD FOR PRODUCING SAME

RELATED APPLICATIONS

This application is the U.S. National Phase under 35 U.S.C. § 371 of International Patent Application No. PCT/JP2015/001269, filed on Mar. 9, 2015, which in turn claims the benefit of Japanese Application No. 2014-051519, filed on Mar. 14, 2014 and Japanese Patent Application No. 2015-001166, filed on Jan. 6, 2015, the disclosures of which Applications are incorporated by reference herein.

TECHNICAL FIELD

The present invention relates to a coil component to be used in various electronic devices and a method for producing the coil component.

BACKGROUND ART

In the recent years, high performance electronic devices are required to be small in size. Meanwhile, the high performance electronic devices tend to use a large amount of current. Thus, a coil component that satisfies those issues is needed.

As illustrated in FIG. 12, a conventional coil component includes body 2 that has coil element 1 made of a wound copper wire coated with an insulation coating and holding members 3 welded to an end portion of coil element 1. Coil element 1 and part of holding members 3 are embedded in mixed powder of metal magnetic powder and a binding agent that is composed of thermosetting resin, and are press formed to form body 2. The conventional coil component further includes terminal 4 that is formed of a combination of an end portion of coil element 1 protruding from a side surface of body 2 and holding member 3, which are bent together.

Note that PTL 1, for example, is known as information on the conventional technology related to the invention of the present application.

CITATION LIST

Patent Literature

PTL 1: Unexamined Japanese Patent Publication No. 2013-191726

SUMMARY OF THE INVENTION

However, a coil component of a smaller size requires holding member 3 having a smaller thickness. Thus, holding member 3 is liable to distort at the periphery portion thereof when holding member 3 is welded to an end portion of coil element 1. Distorted holding member 3 could result in a failure in production as holding member 3 is stuck by a die mold when a part of holding member 3 is embedded in a magnetic core.

In an alternative method, the die mold can have a clearance of a greater dimension; however, such method could lead to a leakage of a magnetic material during a press forming.

A coil component according to an aspect of the present invention can achieve stable formability, even if the coil component is made small in size.

A coil component according to the present invention includes a magnetic core made of a mixture of a powdery magnetic material and a binding agent and obtained by press forming the mixture, a coil element embedded in the magnetic core and having an end portion protruding from the magnetic core, and a holding member configured to hold the end portion of the coil element. The holding member has a first slit and a second slit which faces the first slit. The end portion of the coil element and the holding member are welded together in an area between the first slit and the second slit.

In the above-mentioned configuration, when the end portion of the coil element and the holding member are welded together, the holding member is applied with force that acts to extend the holding member in a direction perpendicular to the direction in which the end portion of the coil element extends; however, the holding member has the first slit and the second slit which can absorb the distortion of the holding member, whereby the shape of the holding member is retained.

Thus, the coil component according to the present invention can reduce a clearance between a die mold and the holding member, even if made small in size, thereby providing production of coil components with improved mass productivity.

A method for producing a coil component according to the present invention includes: a coil portion forming step of spirally winding a conductive wire to form a coil element, a welding step of welding a holding member made of a processed metal plate to an end portion of the coil element, a magnetic core forming step of embedding the coil element in a mixture of a magnetic material and a binding agent and press forming the mixture to form a magnetic core, and a terminal forming step of bending the holding member to form a terminal. The holding member has a first slit and a second slit which faces the first slit. The end portion of the coil element and the holding member are welded together in an area between the first slit and the second slit.

DESCRIPTION OF EMBODIMENTS

Exemplary Embodiment

A coil component according to an exemplary embodiment of the present invention will be described below with reference to FIG. 1, FIG. 2A and FIG. 2B.

Figure 1:
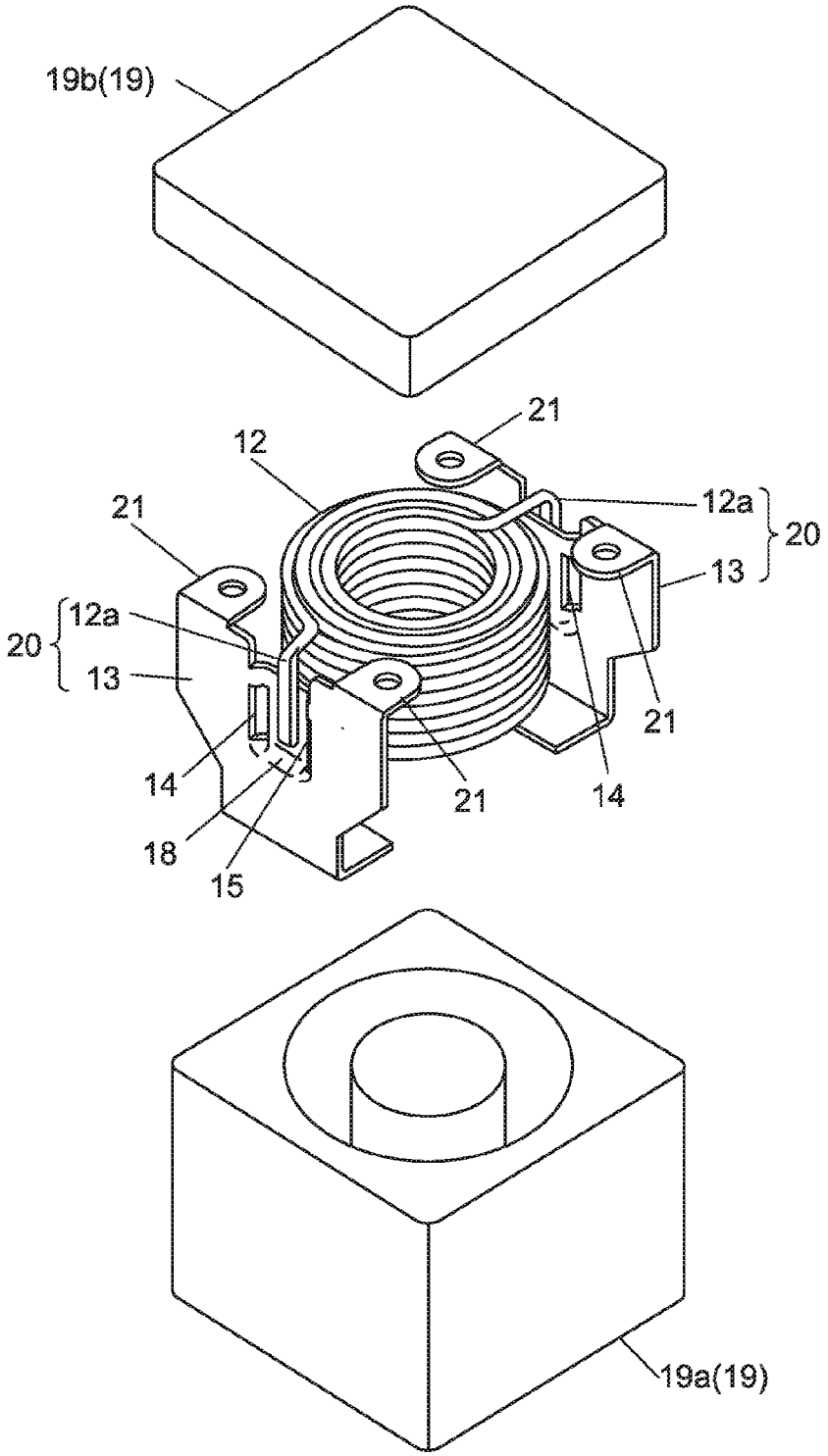
FIG. 1 is an exploded perspective view of a coil component according to an exemplary embodiment of the present invention.
Figure 2A:
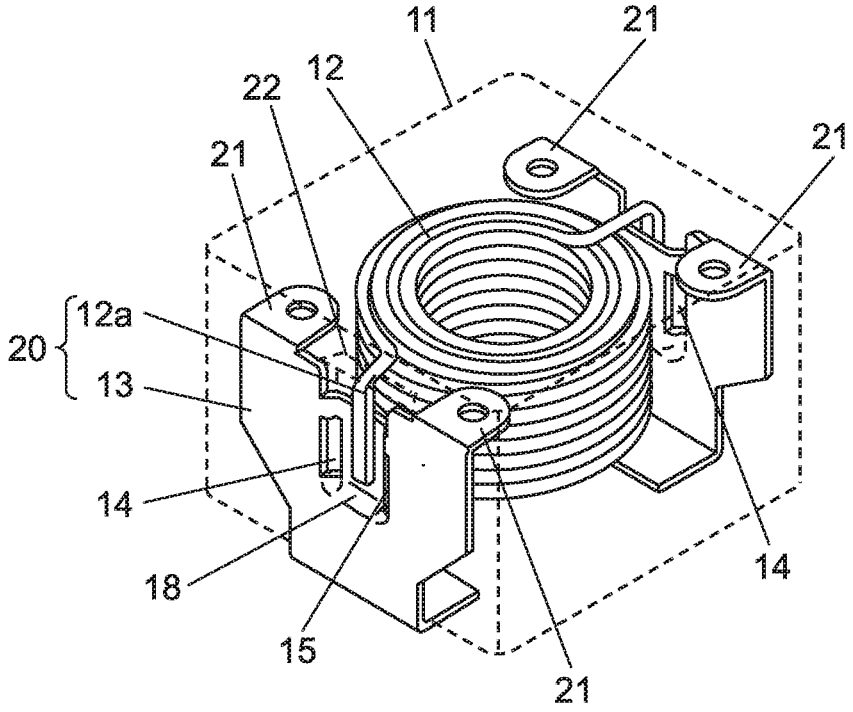
FIG. 2A is a see-through perspective view of the coil component according to the exemplary embodiment of the present invention.
Figure 2B:
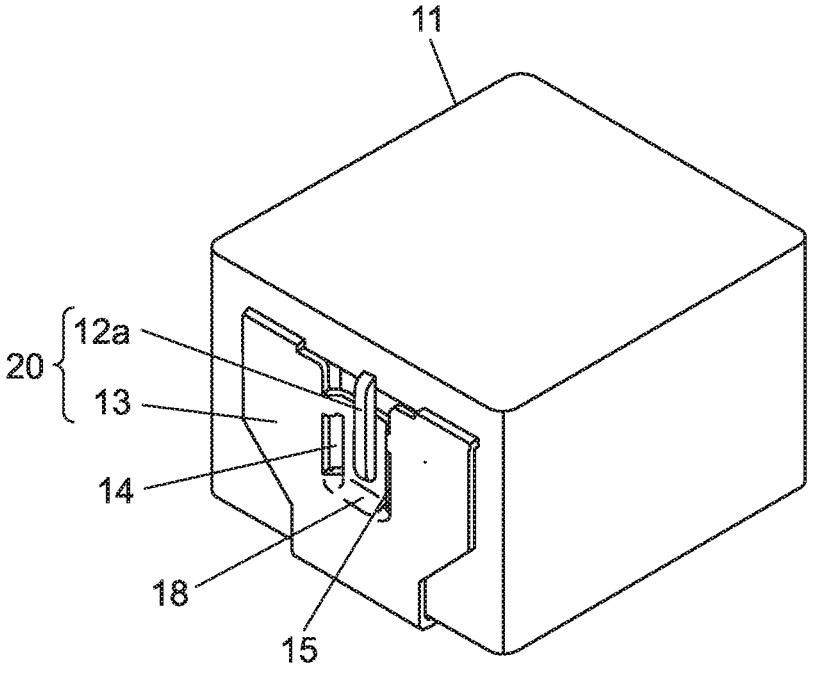
FIG. 2B is a perspective view of the coil component according to the exemplary embodiment of the present invention.

FIG. 1 is an exploded perspective view of the coil component according to the exemplary embodiment of the present invention, FIG. 2A is a see-through perspective view of the coil component according to the exemplary embodiment of the present invention, and FIG. 2B is a perspective view of the coil component according to the exemplary embodiment of the present invention.

It should be noted that FIG. 1 illustrates pressed powder bodies 19 each in a shaped condition, and FIG. 2A and FIG. 2B illustrate magnetic core 11 made of pressed powder body 19 that is in a re-pressed form.

The coil component according to the exemplary embodiment of the present invention includes magnetic core 11 having a rectangular cross section which is made of a mixture of metal magnetic powder and a binding agent and obtained by press forming the mixture, coil element 12 that is made of a conductive wire spirally wound and is embedded in magnetic core 11, and holding members 13 electrically connected by welding to coil element 12.

Magnetic core 11 is formed in such a manner that a binding agent containing thermosetting resin and metal magnetic powder are mixed together while the thermosetting resin is not completely cured, the mixture of the binding agent and the metal magnetic powder is press formed by the force of approximately 1 ton/cm$^2$ to form a plurality of pressed powder bodies 19, pressed powder bodies 19 are re-press formed so as to sandwich and cover coil element 12 and are then subjected to a heat processing so that the thermosetting resin is completely cured. In this method, the re-press forming uses a pressing force of approximately 5 ton/cm$^2$ that is greater than that of the press forming, whereby pressed powder bodies 19 after they are re-press formed are thinner in thickness than pressed powder bodies 19 before they are re-press formed, and thus the forming density of pressed powder bodies 19 increases.

As illustrated in FIG. 1, magnetic core 11 in the exemplary embodiment is made of two pressed powder bodies 19*a*, 19*b*. Pressed powder body 19*a*, which is one of the pressed powder bodies, has a rectangular column shape and includes a storage portion in which coil element 12 is completely stored. Other pressed powder body 19*b* has a lid shape and is placed on pressed powder body 19*a*. End portions 12*a* of the coil element and holding members 13 protrude from an interface between two pressed powder bodies 19*a*, 19*b*.

Coil element 12 is made of an insulation coated copper wire having a diameter of approximately 0.3 mm and is wound spirally. Holding members 13 each are made of a copper plate having a thickness of approximately 0.15 mm that is punched into holding member 13. Holding members 13 each have protruding portion 21 that is embedded in magnetic core 11 so as to secure holding member 13 to magnetic core 11. Holding members 13 exposed from outer side surfaces of magnetic core 11 may be applied, if required, with a soldering dip so as to provide a soldering coating on the surfaces thereof. Holding members 13 each are subjected to a bending process of bending holding member 13 from a side surface to a bottom surface of magnetic core 11, thereby forming terminal 20.

Each of holding members 13 has first slit 14 and second slit 15 which faces the first slit. First slit 14 and second slit 15 each have a width of approximately 0.3 mm and a length of approximately 1.2 mm. First slit 14 faces second slit 15 so that the longitudinal direction of first slit 14 is in parallel with the longitudinal direction of second slit 15. The distance between first slit 14 and second slit 15 is approximately 1 mm. Holding member 13 and end portion 12*a* of the coil element are welded together in an area between first slit 14 and second slit 15. The area where the two members are welded together has a length of approximately 1 mm in a direction in which end portion 12*a* of the coil element extends and a width of approximately 0.3 mm. When holding member 13 and end portion 12*a* of the coil element are welded together, holding member 13 is liable to receive force in a direction perpendicular to a direction in which end portion 12*a* of the coil element extends, and thus holding member 13 is liable to be displaced in a width direction thereof. As a result, protruding portion 21 is displaced in the width direction, which can cause protruding portion 21 to be pinched in a die mold during a press forming. However, in the exemplary embodiment, first slit 14 and second slit 15 are provided at both sides, in the width direction, of the area where holding member 13 and end portion 12*a* of the coil element are welded together. Thus, the force acting in the width direction is absorbed, even if holding member 13 is made of a soft material such as copper and made of a thin material, whereby protruding portion 21 is restrained from displacement.

In addition, the area where end portion 12*a* of coil element 12 overlaps with holding member 13 is located at step-formed portion 18 that is recessed by approximately 0.2 mm from the rest of holding member 13 toward magnetic core 11. First slit 14 and second slit 15 are respectively provided to left and right end portions of step-formed portion 18. With such a configuration, the coil component can have a side surface of a limited external protuberance, and step-formed portion 18 can be readily formed.

It should be noted that in the exemplary embodiment, first slit 14 and second slit 15 are formed at the left and right end portions of step-formed portion 18, respectively; however, first and second slits 14, 15 may be formed at any locations and not restricted to the mentioned portions.

First Modification of Exemplary Embodiment

Next, with reference to FIG. 3, the slits having a modified shape will be described. The configuration illustrated in FIG. 3 is different from that in FIG. 2A only in first slit 14 and second slit 15, and thus description regarding to the remaining members will be excluded.

Figure 3:
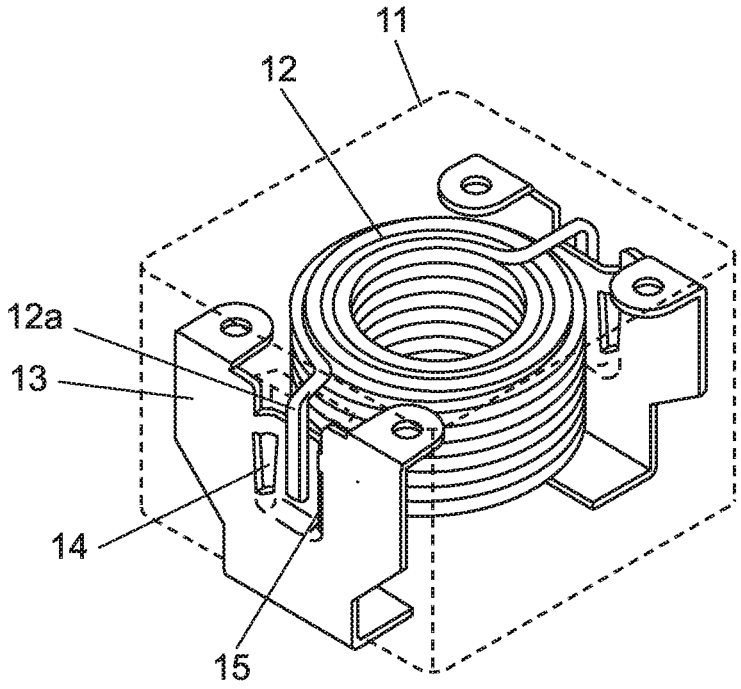
FIG. 3 is a see-through perspective view of another coil component according to an exemplary embodiment of the present invention.

In the coil component illustrated in FIG. 3, first slit 14 and second slit 15 each have a proximal-side width of approximately 0.3 mm that is near the area where end portion 12*a* of the coil element protrudes from magnetic core 11 and a distal-side width of approximately 0.2 mm. In other words, first slit 14 and second slit 15 each have a width wherein a portion close to the area where end portion 12*a* of coil element 12 protrudes from magnetic core 11 is greater than a portion away from said area.

With this configuration, when holding member 13 is applied with a soldering dip, first slit 14 and second slit 15 allow an easy entrance of the solder into slits 14, 15, thereby enhancing the strength of a terminal.

Second Modification of Exemplary Embodiment

Next, with reference to FIG. 4, the slits having another modified shape will be described. The configuration illustrated in FIG. 4 is different from that in FIG. 2A only in third slit 16 that is additionally provided, and thus the description for the remaining configuration will be omitted.

Figure 4:
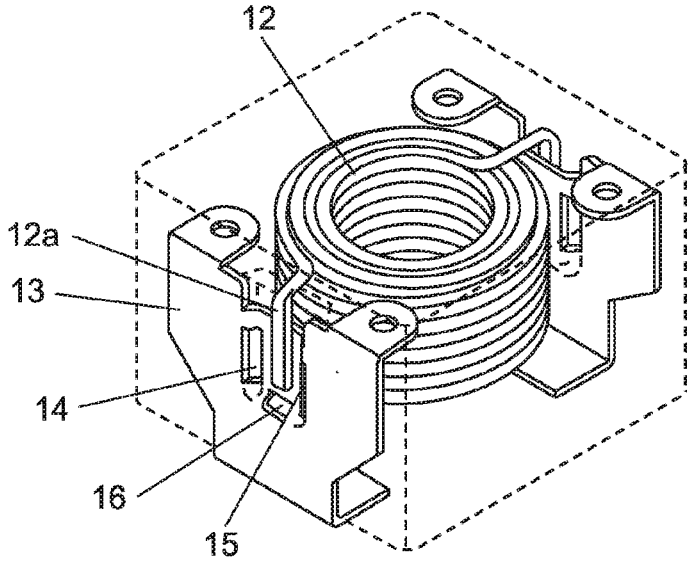
FIG. 4 is a see-through perspective view of still another coil component according to an exemplary embodiment of the present invention.

As illustrated in FIG. 4, third slit 16 is provided to holding member 13 at a location that is an extension, in the direction in which end portion 12*a* of the coil element extends, of the area where end portion 12*a* of coil element 12 is positioned between first slit 14 and second slit 15. Third slit 16 has dimension of approximately 0.6 mm in the width direction of holding member 13 and has a dimension of approximately 0.3 mm in the direction in which end portion 12*a* of coil element 12 extends, and is positioned approximately 0.5 mm away from first slit 14 and second slit 15. In addition, third slit 16 is adapted to be disposed in a location to which the area between first slit 14 and second slit 15 linearly extend. This configuration can reduce the force acting on holding member 13, during welding, in the direction in which end portion 12*a* of the coil element extends.

It should be noted that third slit 16 in this exemplary embodiment is formed at the lower end of step-formed portion 18; however, the position of third slit 16 to be formed is not limited to such a location.

Third Modification of Exemplary Embodiment

Next, with reference to FIG. 5, the slits having another modified shape will be described. It should be noted that the configuration illustrated in FIG. 5 is different from that of in FIG. 2A only in fourth slit 17 that is additionally provided, and thus description of the remaining configuration is omitted.

Figure 5:
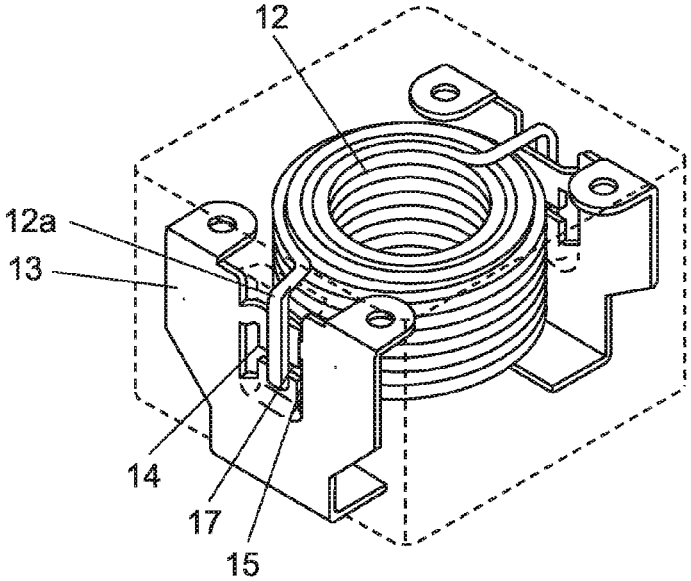
FIG. 5 is a see-through perspective view of yet another coil component according to an exemplary embodiment of the present invention.

As illustrated in FIG. 5, holding member 13 has fourth slit connecting first slit 14 with second slit 15. End portion 12*a* of the coil element and holding member 13 are welded together in the area across fourth slit 17. This configuration can reduce, in welding, the force acting on holding member 13 in the direction in which end portion 12*a* of the coil element extends.

Fourth Modification of Exemplary Embodiment

Figure 6:
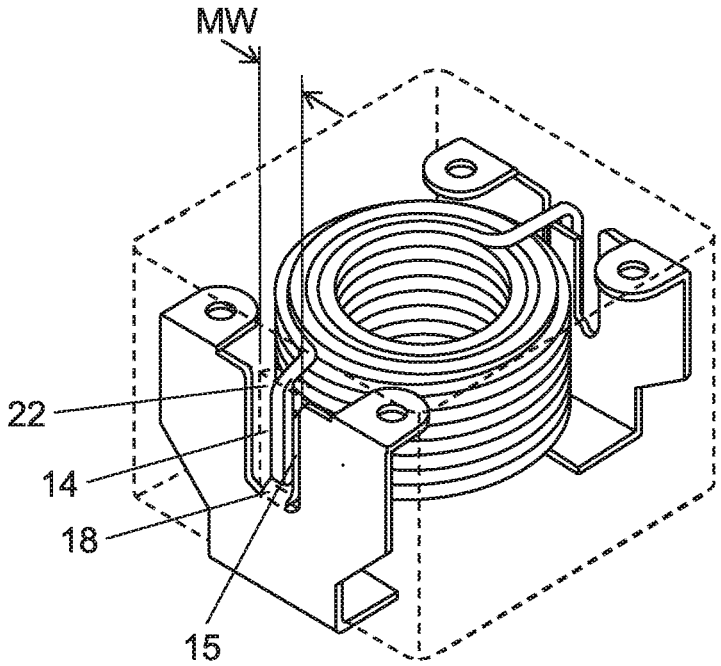
FIG. 6 is a see-through perspective view of yet another coil component according to an exemplary embodiment of the present invention.

Next, with reference to FIG. 6, the slits having another modified shape will be described. The configuration illustrated in FIG. 6 differs from that in FIG. 2A only in the shape of first slit 14 and second slit 15, and thus the description of the remaining configuration will be omitted.

In the above-mentioned exemplary embodiments, first slit 14 and second slit 15 each are formed by a long hole shape. Alternatively as illustrated in FIG. 6, in the modified exemplary embodiment, there may be formed a notch that extends from an edge of holding member 13 at a side of magnetic core 11 in the direction in which holding member 13 extends (the direction toward the bottom surface of magnetic core 11). The configuration illustrated in FIG. 6 is able to exhibit the same effects as the above-mentioned exemplary embodiments.

In addition, in the case where step-formed portion 18 is formed in an area where end portion 12*a* of the coil element overlaps with holding member 13, and in the case where there is provided accommodating groove 22, for accommodation of step-formed portion 18, which is formed in a side surface of magnetic core 11 and configured to extend from the location where end portion 12*a* of the coil element protrudes to the bottom surface of magnetic core 11, accommodating groove 22 is allowed to have a width (MW) that is narrower than that of accommodating groove 22 (see FIG. 2A, for example) prepared for the case where first slit 14 and second slit 15 are formed by a long hole. This arrangement prevents reduction of a dimension of the cross section of magnetic core 11, thereby improving the magnetic property of magnetic core 11.

It should be noted that FIG. 2A and FIGS. 3 to 6 each are see-through perspective view in which magnetic core 11 is shown in a see-through manner and the contour of magnetic core 11 is depicted by the dotted line.

[Method for Producing Coil Component]

Next, a method for producing a coil component according to the exemplary embodiment of the present invention will be described.

Figure 7:
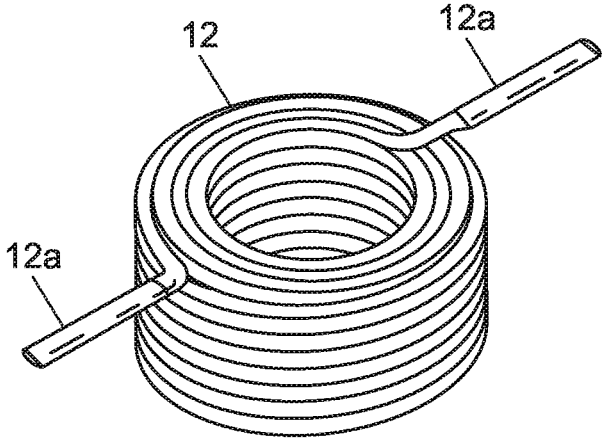
FIG. 7 is a view illustrating a method for producing a coil component according an exemplary embodiment of the present invention.

As illustrated in FIG. 7, a copper wire having a surface provided with an insulation coating is wound in a spiral form so as to form coil element 12 with leading lines drawn out in the left and right sides of coil element 12, respectively. Then, the insulation coatings provided to end portions 12*a* of coil element 12 are removed at sections where respective holding members 13 are to be welded.

Figure 8:
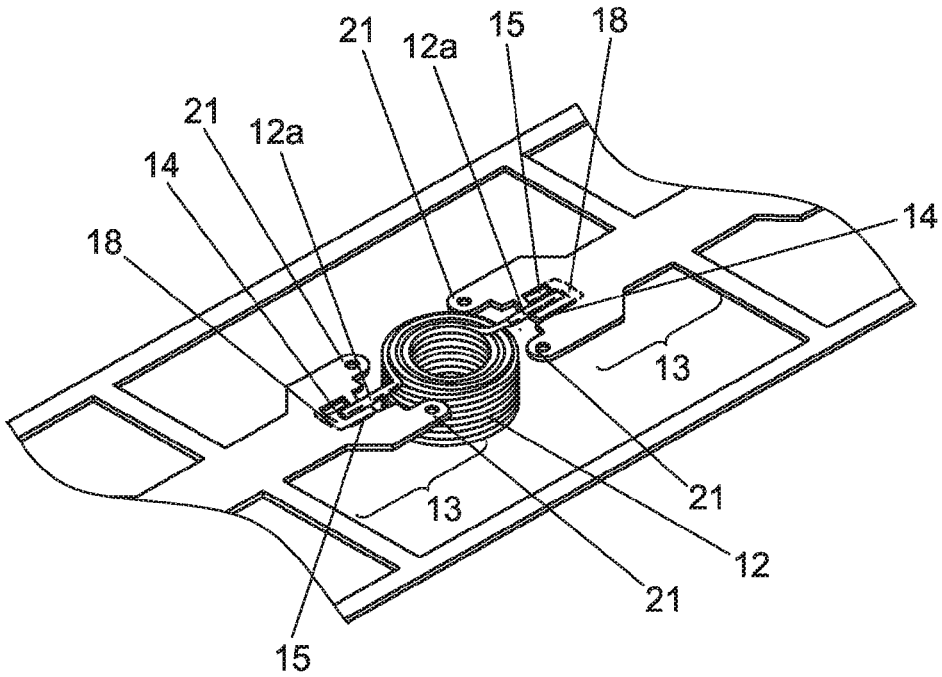
FIG. 8 is a view illustrating the method for producing a coil component according to the exemplary embodiment of the present invention.

Next, as illustrated in FIG. 8, a copper plate is punched by a die mold to form holding members 13 each in a hoop form. Coil element 12 is laid on holding members 13, each in a hoop form, and is partially welded so that coil element 12 is secured to holding members 13. In the punching operation by the die mold, first slit 14 and second slit 15 can also be punch formed simultaneously. Then, each of holding members 13 is preferably processed to form step-formed portion 18 in an area where press welding is applied, which step-formed portion 18 is recessed by approximately 0.2 mm from the remaining area of holding member 13 toward a magnetic core. Step-formed portion 18 has first slit 14 and second slit 15 at respective end portions thereof.

Provision of step-formed portion 18 allows a coil component to have a limited external protuberance at a side surface thereof, and formation of first slit 14 and second slit 15 at respective end portions of step-formed portion 18 allows an easy formation of step-formed portion 18. Holding member 13 and corresponding end portion 12*a* of the coil element are welded together in an area between first slit 14 and second slit 15. When holding member 13 and end portion 12*a* of the coil element are welded together, holding member 13 is liable to receive the force that acts in a direction perpendicular to the direction in which end portion 12*a* of the coil element extends. However, first slit 14 and second slit 15 are provided in positions where the force is directed to act, and thus first slit 14 and second slit 15 absorb the force, thereby restricting the distortion of holding member 13.

In addition, as illustrated in FIG. 8, protruding portions 21 are preferably formed at opposite sides of an area where end portion 12*a* of coil element 12 overlaps with holding member 13, whereby holding member 13 is formed into a U-shape. Preferably, protruding portions 21 are configured so as to be embedded in magnetic core 11. This configuration restricts drawing of holding member 13 out of magnetic core 11, and allows holding member 13 to be readily bent.

Figure 9:
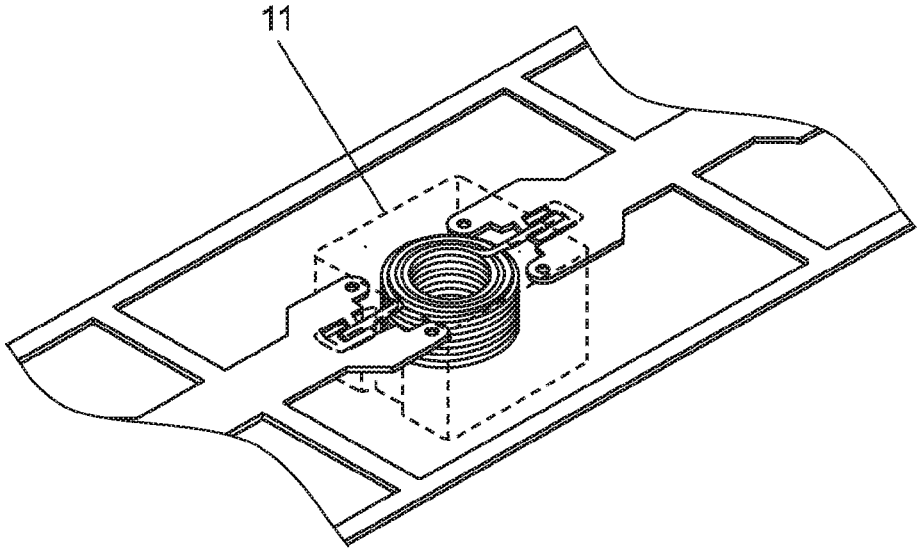
FIG. 9 is a view illustrating the method for producing a coil component according to the exemplary embodiment of the present invention.

Next, as illustrated in FIG. 9, a binding agent containing thermosetting resin and metal magnetic powder are mixed together while the thermosetting resin is no completely cured, and the mixture thereof is dried and powdered to prepare a magnetic material. The magnetic material is then press formed under a force of approximately 1 ton/cm$^2$ to thereby form a plurality of pressed powder bodies 19*a*, 19*b* as illustrated in FIG. 1. Pressed powder bodies 19*a*, 19*b* are re-press formed under a force of approximately 5 ton/cm$^2$ while they sandwich coil element 12. Pressed powder body 19 covering coil element 12 forms the shape of magnetic core 11 (as shown in FIG. 9) of a coil component. Pressed powder body 19 is then subjected to a heat processing at a temperature of approximately 180° C. or higher to completely cure magnetic core 11.

Figure 10:
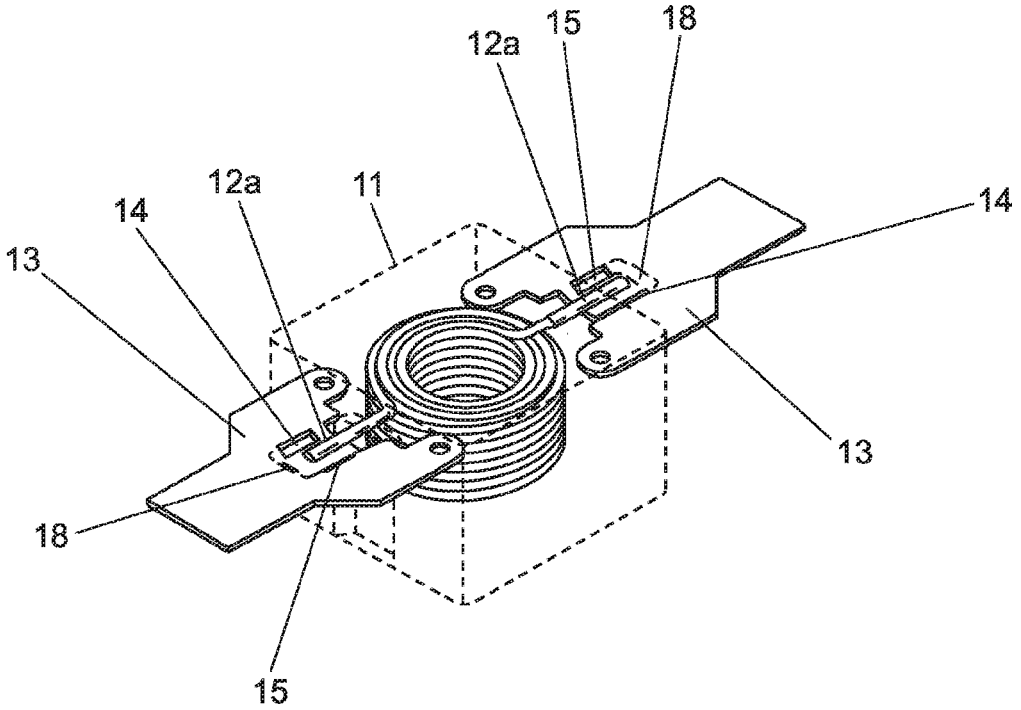
FIG. 10 is a view illustrating the method for producing a coil component according to the exemplary embodiment of the present invention.

Next, as illustrated in FIG. 10, holding members 13 each are cut and removed from the hoops to be made into a single piece. Then, holding members 13 are applied with flux and applied with a soldering dip, whereby parts of holding members 13 protruding from magnetic core 11 and respective end portions 12*a* of the coil element are soldered together. This method is able to provide such a configuration that holding members 13 and coil element 12 are not connected with each other in the area embedded in magnetic core 11 and are connected with each other in the area outside magnetic core 11.

Specifically the method for producing a coil component according to the exemplary embodiment of the present invention includes: a coil portion forming step of spirally winding a conductive wire to form coil element 12; a welding step of welding holding member 13 made of a processed metal plate to end portion 12*a* of coil element 12; a magnetic core forming step of embedding coil element 12 in a mixture of a magnetic material and a binding agent and press forming the combination thereof to form magnetic core 11; and a terminal forming step of bending holding member 13 to form terminal 20. In addition, holding member 13 has first slit 14 and second slit 15 which faces first slit 14. Furthermore, end portion 12*a* of coil element 12 and holding member 13 are welded together in an area between first slit 14 and second slit 15.

More preferably first slit 14 and second slit 15 are provided to step-formed portion 18.

Furthermore, as described with reference to FIG. 3, first slit 14 and second slit 15 each may have a proximal-side width of approximately 0.3 mm that is near the area where end portion 12*a* of the coil element protrudes from magnetic core 11 and a distal-side width of approximately 0.2 mm.

Specifically, in the method for producing a coil component according to the exemplary embodiment, first slit 14 and second slit 15 each have a width of which a portion close to the area where end portion 12*a* of coil element 12 protrudes from magnetic core 11 is wider than a portion away from said area. In addition, holding member 13 and end portion 12*a* of coil element 12 are applied with a soldering dip. In this production method, when holding member 13 is applied with a soldering dip, first slit 14 and second slit 15 allow an easy entrance of the solder into slits 14, 15, thereby enhancing the strength of a terminal.

Figure 11:
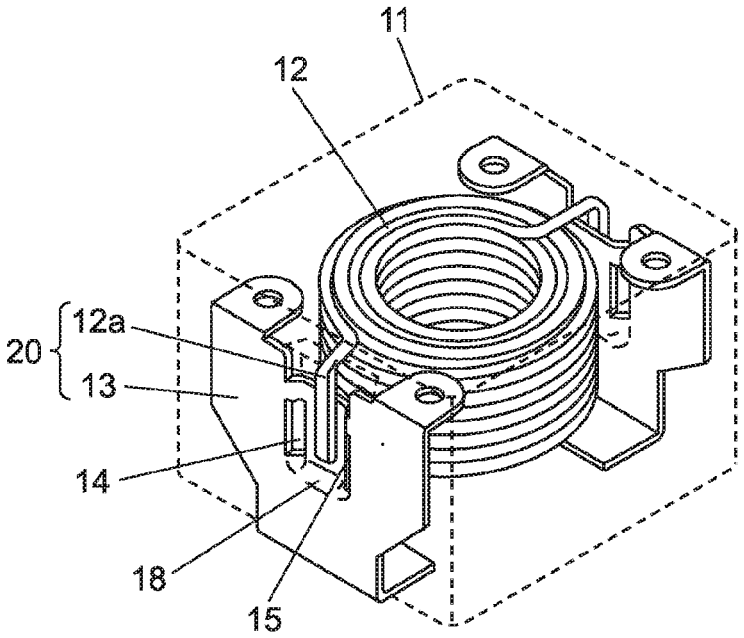
FIG. 11 is a view illustrating the method for producing a coil component according to the exemplary embodiment of the present invention.
Figure 12:
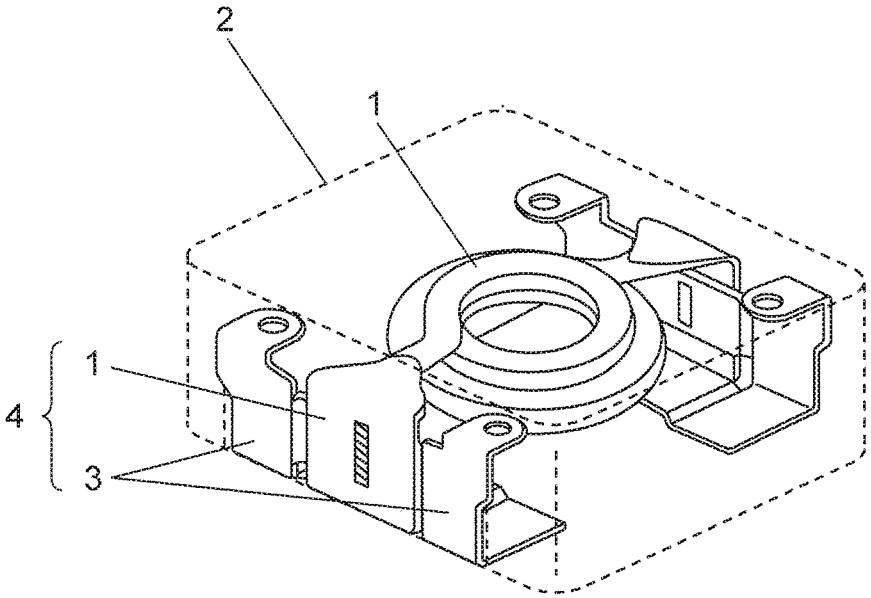
FIG. 12 PRIOR ART
FIG. 12 is a see-through perspective view of a conventional coil component.

Holding member 13 and end portion 12*a* of coil element 12 are unified to form terminal 20 that is cut into a predetermined length and is bent to form a coil component as illustrated in FIG. 11.

It should be noted that FIG. 9, FIG. 10, and FIG. 11 each are a see-through perspective view illustrating magnetic core 11 in a see-through manner, in which the contour of magnetic core 11 is depicted by the dotted line.

In addition, as illustrated in FIG. 4, third slit 16 may be provided to holding member 13 at a location that is an extension, in the direction in which end portion 12*a* of the coil element extends, of the area where end portion 12*a* of coil element 12 is positioned between first slit 14 and second slit 15. Third slit 16 has a dimension of approximately 0.6 mm in the width direction of holding member 13 and has a dimension of approximately 0.3 mm in the direction in which end portion 12*a* of coil element 12 extends, and is positioned approximately 0.5 mm away from first slit 14 and second slit 15.

It should be noted that in the case where holding member 13 has step-formed portion 18, first slit 14, second slit 15, and third slit 16 may be provided to step-formed portion 18.

In a method for producing such a coil component, the force acting on holding member 13, during a welding process, in the direction in which end portion 12*a* of the coil element extends can be reduced, and step-formed portion 18 can be readily formed.

Furthermore, as illustrated in FIG. 5, holding member 13 may have fourth slit 17 connecting first slit 14 with second slit 15. End portion 12*a* of the coil element and holding member 13 may be welded together in the area including fourth slit 17 and across fourth slit 17.

In the method for producing a coil component, the force acting on holding member 13, during a welding process, in the direction in which end portion 12*a* of the coil element extends can be reduced.

It should be noted that in the exemplary embodiment described above, first slit 14 and second slit 15 each is formed by a long hole. Alternatively, as illustrated in FIG. 6, each slit may be formed by a notch that extends from an edge of holding member 13 at a side of magnetic core 11 in the direction in which holding member 13 extends (in the direction of the bottom surface of magnetic core 11). This method for producing a coil component can exhibit the same effects as the above-mentioned production methods.

In addition, in the case where step-formed portion 18 is formed in an area where end portion 12*a* of the coil element overlaps with holding member 13, and in the case where there is provided an accommodating groove (not illustrated), for accommodation of step-formed portion 18, which is formed in a side surface of magnetic core 11 and configured to extend from the location where end portion 12*a* of the coil element protrudes to the bottom surface of magnetic core 11, accommodating groove 22 is allowed to have a width (MW) that is narrower than that of accommodating groove 22 (see FIG. 2A, for example) prepared for the case where first slit 14 and second slit 15 are formed by a long hole. Thus, when holding member 13 is bent from a side surface of magnetic core 11 to a bottom surface thereof, holding member 13 is allowed to make a contact with an edge of magnetic core 11 between the side surface and the bottom surface of magnetic core 11, whereby holding member 13 can be bent in a stable form.

INDUSTRIAL APPLICABILITY

The coil component and the method for producing the coil component according to the present invention can reduce a clearance between a die mold and a holding member, even if the coil component is made small in size, thereby providing production of coil components with improved mass productivity.

REFERENCE MARKS IN THE DRAWINGS

11 magnetic core
12 coil element
12*a* end portion
13 holding member
14 first slit
15 second slit
16 third slit
17 fourth slit
18 step-formed portion
19, 19*a*, 19*b* pressed powder body
20 terminal
21 protruding portion
22 accommodating groove

The invention claimed is:

1. A coil component comprising:

a magnetic core made of a mixture of a powdery magnetic material and a binding agent and obtained by press forming the mixture;

a coil element formed by winding a conductive wire, embedded in the magnetic core and having an end portion protruding from the magnetic core; and a holding member configured to hold the end portion of the coil element, the holding member having a side face, wherein:

the holding member has a recess portion, at the side face, protruding toward a center of the magnetic core, the holding member has, in the side face, a first slit and a second slit which faces the first slit, the end portion of the coil element is welded to the recess portion of the holding member and the holding member are welded together in an area between the first slit and the second slit, and the recess portion has a convex surface facing the magnetic core and a concave surface opposite to the convex surface, and the end portion of the coil element is welded to the concave surface.

2. The coil component according to claim 1, wherein the first slit and the second slit each have a proximal-side width near an area where the end portion of the coil element protrudes from the magnetic core and a distal-side width far from the area, the proximal-side width being greater in dimension than the distal-side width.

3. The coil component according to claim 1, wherein the holding member has a third slit positioned in an area to which the end portion of the coil element is directed to extend.

4. The coil component according to claim 1, wherein the holding member has a fourth slit connecting the first slit with the second slit.

5. A method for producing a coil component, the method comprising:

a coil portion forming step of spirally winding a conductive wire to form a coil element;

a welding step of welding an end portion of the coil element to a holding member made of a processed metal;

a magnetic core forming step of embedding the coil element in a mixture of a magnetic material and a binding agent and press forming the mixture to form a magnetic core;

after the welding step, a terminal forming step of bending the holding member to form a terminal, wherein the holding member has a recess portion, a first slit and a second slit which faces the first slit, the end portion of the coil element and the holding member are welded together to the recess portion at an area between the first slit and the second slit, the recess portion has a convex surface facing the magnetic core and a concave surface opposite to the convex surface, and the end portion of the coil element is welded to the concave surface in the welding step.

6. The method for producing a coil component according to claim 5, wherein the first slit and the second slit each have a proximal-side width near an area where the end portion of the coil element protrudes from the magnetic core and a distal-side width far from the area, the proximal-side width being greater in dimension than the distal-side width, and the holding member and the end portion of the coil element are applied with a soldering dip.

7. The method for producing a coil component according to claim 5, wherein the step-formed portion of the holding member has a third slit positioned in an area to which the end portion of the coil element is directed to extend.

8. The method for producing a coil component according to claim 5, wherein the step-formed portion of the holding member has a fourth slit connecting the first slit with the second slit.

* * * * *